US006718884B1

(12) United States Patent
Yabuta et al.

(10) Patent No.: US 6,718,884 B1
(45) Date of Patent: Apr. 13, 2004

(54) INITIATOR ASSEMBLY

(75) Inventors: Mikio Yabuta, Hyogo (JP); Nobuyuki Katsuda, Hyogo (JP)

(73) Assignee: Daicel Chemical Industries, Ltd., Osaka (JP)

( * ) Notice: Subject to any disclaimer, the term of this patent is extended or adjusted under 35 U.S.C. 154(b) by 0 days.

(21) Appl. No.: 10/070,140

(22) PCT Filed: Sep. 27, 2000

(86) PCT No.: PCT/JP00/06663

§ 371 (c)(1),
(2), (4) Date: Mar. 4, 2002

(87) PCT Pub. No.: WO01/23826

PCT Pub. Date: Apr. 5, 2001

(30) Foreign Application Priority Data

Sep. 27, 1999 (JP) ..... 11-272777
Sep. 20, 2000 (JP) ..... 2000-285402

(51) Int. Cl.[7] ..... B60R 21/26; F42C 19/12

(52) U.S. Cl. ..... 102/530; 102/202.5; 102/202.9; 102/202.14; 280/741

(58) Field of Search ..... 102/202.5, 202.6, 102/202.7, 202.8, 202.9, 202.14, 530, 531; 280/741

(56) References Cited

U.S. PATENT DOCUMENTS 5,200,574 A * 4/1993 Cunningham et al. ..... 102/530
5,772,243 A * 6/1998 Green et al. ..... 280/741
5,955,699 A * 9/1999 Perotto et al. ..... 102/530
6,073,963 A * 6/2000 Hamilton et al. ..... 280/741
6,155,171 A * 12/2000 Haegeman et al. ..... 102/202.9
6,491,321 B1 * 12/2002 Nakashima et al. ..... 280/741

FOREIGN PATENT DOCUMENTS

JP 3005753 U 10/1994
JP 9-506965 A 7/1997
JP 10-35400 A 2/1998
JP 11-321541 A 11/1999

* cited by examiner

*Primary Examiner*—Harold J. Tudor
(74) *Attorney, Agent, or Firm*—Birch, Stewart, Kolasch & Birch, LLP

(57) ABSTRACT

The invention provides an initiator assembly that can be easily manufactured without increasing cost, and can be easily and securely connected to a connector when it is used. The initiator assembly includes a priming for being used in a motor vehicle, an initiator used for igniting the priming and having at least one conductive pin and a metal collar for fixing the initiator assembly on an inflator that are integrally formed by an insulating material injection-molded therebetween. The insulating material is a resin made of a plastic material that surrounds a metal eyelet of the initiator.

16 Claims, 6 Drawing Sheets

D FEATURE TYPE

T FEATURE TYPE

INITIATOR ASSEMBLY

This application is the national phase under 35 U.S.C. §371 of PCT International Application No. PCT/JP00/06663 which has an International filing date of Sep. 27, 2000, which designated the United States of America.

TECHNICAL FIELD

The present invention relates to an inflator for filling up an air bag for a motor vehicle or an inflatable article, and more particularly to an initiator (an electric trigger device) assembly for igniting a propellant (that is, a gas generating agent) in an inflator.

PRIOR ART

An initiator for inflating an air bag of a motor vehicle or the other expansible article includes an initiator assembly for igniting a propellant (a gas generating agent) stored in a housing of an inflator. The inflator activates the propellant (the gas generating agent) with activation of the initiator assembly so as to generate a gas for filling the inflatable article. The initiator assembly generally has an outer shape or includes a member for being connected to a supporting structure (for example, a structure in an inner tube of the inflator).

Conventionally, there has been known an initiator having an outer metal casing with a boss or a collar for connecting to an inflator housing. The collar is positioned on an outer periphery of an insulating material surrounding a conductive pin of the initiator. Further, in a design of another known initiator assembly, there has been known a cover having an injection-molded portion made of a plastic material surrounding an initiator. Such an initiator assembly is disclosed, for example, in JP-A 9-506965 and JP-A No. 11-321541.

In JP-A 9-506965, there is disclosed an initiator assembly in which a casing is made of a metal wall mounted to an metal end plate, and is provided with a molded product made of a plastic material so as to be formed in such a manner as to surround an end plate and a part of an electrode inserted to the end plate.

Further, in JP-A No. 11-321541, there is disclosed an initiator assembly having an inserted member which is injection-molded with an insulating material to be unified and being characterized by a shoulder portion having a comparatively short length and engaging with a trigger device adapter.

However, it is desired to make it further easier to connect the initiator assembly to the inflator housing as well as reducing a size of the injection-molded portion of the plastic material. However, it is impermissible that such the initiator aspect applies a further load to production of the initiator assembly and increases a manufacturing cost of the initiator assembly.

DISCLOSURE OF THE INVENTION

The present invention is made so as to solve the problems mentioned above, and an object of the present invention is to provide an initiator assembly which can be easily manufactured without increasing a cost, and can be easily and securely connected to a connector at a time of being used.

In accordance with the present invention, there can be provided an initiator assembly in which an inflator is improved. The initiator assembly ignites and burns a priming arranged close to a conductive pin of the initiator when it is activated with an igniting signal received by the conductive pin. The initiator assembly includes an initiator and a collar assembly joined to the initiator. In addition to at least one conductive pin, the initiator can have a cap member (a charge holder) made of a metal wall surrounding the priming to be ignited when the igniting signal is received. The collar assembly holds the initiator with respect to a housing of the inflator even after being activated.

The initiator assembly according to the present invention corresponds to an initiator assembly in which an initiator used for igniting a priming and having at least one conductive pin and a metal collar for holding the initiator assembly with respect to an inflator are integrally formed by an insulating material injection-molded between both members. In the case of employing a plastic material capable of being injection-molded as an insulating material, the injection-molded plastic material is solidified so as to form a molded resin portion, which connects integrally the initiator with the metal collar. In other words, the initiator, the metal collar and the insulating material existing between both members are simultaneously integrated due to the injection-molding of the insulating material so as to form the initiator assembly. In this case, in the present specification, for convenience of explanation, a combination of the injection-molded insulating material and the metal collar is referred as a collar assembly, and a combination of the collar assembly and the initiator is referred as an initiator assembly.

The collar assembly includes the injection-molded insulating material (hereinafter, also refer to as an insulating material in the same meaning) and the metal collar, and the metal collar is fixed and joined to the insulating material made of the injection-molded plastic material during an injection-molding process. The insulating material is useful for insulating one conductive pin from a second conductive pin, or in another aspect, the insulating material is useful for insulating one conductive pin from another conductive component in a different electric potential when the one conductive pin receives the igniting signal. The metal collar is a single integral piece and can be defined as one including a body portion and a shoulder portion. In the body portion, a front end annular cylindrical body portion thereof is arranged to be fitted and fixed to an outer periphery of the insulating material made of a molding plastic which is injection-molded to surround two conductive pins normally comprising a center pin and a grounding pin, the conductive pin extends into a cylindrical body portion (that is, a rear half portion) extending rearward, and a connector connected to the conductive pin is received in the inner space of the rear cylindrical body. In this metal collar, it is desirable that the rearward extending cylindrical body portion is formed so that the inner periphery thereof is not covered with an insulating material (that is, an injection-molded resin or the like) and the metal collar is exposed. This is for unfailingly preventing a connector arranged in the inner space of the circular portion from dropping out due to an impact at a time of activation of the initiator or the like.

The shoulder portion can be formed at a position at which the metal collar is separated into substantially a front half portion and a rear half portion, and is protruded outwardly in the radial direction from the body portion so as to be contacted and engaged with an engaging portion of the inflator housing. A mutual engagement between the shoulder portion and the engaging portion of the inflator housing controls a relative positioning of the initiator assembly with respect to the inflator housing before and after activating the initiator assembly. The outward position of the shoulder portion defines an outer length or size of the metal collar.

The initiator assembly according to the present invention can be formed, for example, as a structure in which the priming is stored in the charge holder composed of a cylindrical metal wall mounted to a metal eyelet (an end plate), the metal eyelet has a perforated cylindrical shape and a central hole is filled with an electric insulating body (normally made of a glass). In this case, the center pin of the electrode goes through the insulating material in the metal collar, continuously goes through the electric insulating body in the eyelet, and a front end thereof is connected to the priming. Further, the upper surface of the eyelet is in contact with the priming, and the second conductive pin, that is, a front end of the grounding pin of the electrode is connected to the lower surface of the eyelet in a state capable of turning on electricity. As the priming stored in the charge holder, a zirconium-potassium perchlorate material can be used. Further, the means for triggering the priming upon the igniting signal is provided between the center pin and the eyelet. That is, it is constituted by a resistance line connected between members.

The initiator assembly according to the present invention can accompany with the following features.

(1) A projection is formed on an outer peripheral surface of the insulating material (the molding resin portion) surrounding the metal eyelet (the end plate) in order to increase a friction between the inner tube of the inflator and the initiator assembly and to prevent the initiator assembly from being shaky and rotating, thereby facilitating a crimping process of the inner tube. It is desirable that the projection is formed in various kinds of conical shapes such as a circular cone, a rectangular cone, however, may be formed in the other shapes, for example, in a belt-like shape along the circumferential direction, that is, can be optionally formed in a shape as far as being fitted between the inner tube and the initiator assembly and capable of increasing a frictional resistance. Further, this projection is formed to be slightly larger than a gap obtained between the inner tube and the initiator assembly, and is formed so as to press-insert the initiator assembly to the gap between the initiator assembly and the inner tube by being crushed or bent at a time of joining the initiator assembly to one end of the inner tube. In order to obtain the function mentioned above, for example, in the case that the width of the gap is 0.75 mm, it is realized by making the projection about 0.1 to 0.2 mm larger than the gap.

(2) The connector in the metal collar and the center pin and the grounding pin in the connecting space are made such as not to be protruded from the collar for preventing the pin from being deformed during assembling the initiator assembly.

(3) A dislocation-preventing means of the connector is provided in the connecting space for the connector inside the metal collar. A recessed notch can be provided in the metal collar as the preventing means.

(4) The inner side of the metal collar is not covered by the injection-molded insulating material (the molding plastic material), and the connector is fitted to the metal surface within the collar so as to be directly brought into contact therewith. Accordingly, it is possible to prevent the connector from being taken out due to a reaction at a time of operating the initiator.

(5) A mounting means of the connector with a lead wire is provided so as to decide a particular direction of the lead wire with respect to the inflator. In particular, a recess or a projection extending in the axial direction is provided in an edge portion of the metal collar in an unsymmetrical way.

In accordance with the present invention, the initiator assembly which can be easily connected to the inflator housing is provided. Mutual connection between the inflator housing, the connector and the initiator assembly can be achieved, and the connector cannot be dislocated at a time of activation. In the present invention, the injection-molding of the insulating material, that is, the molding plastic material (the molding resin) in the metal collar promotes an assembling process of the initiator assembly. In particular, the metal collar is integrally fitted to the outer periphery of the plastic molded body, and the electrode pin of the initiator assembly is connected unfailingly to the connector without having the insulating material inside the portion for connecting the connector and without dislocation at the time of activation, which is achieved by the present invention for the first time.

Further, the respective end surfaces of the center pin, the eyelet and the electric insulating body are on the same plane, are integrally resin-molded, including the metal collar, and can be formed as a pin type. The pin type corresponds to the initiator having the conductive pin protruded into the inner space of the rear cylindrical body of the body portion in the collar assembly, particularly the metal collar, in which the conductive pin and the lead wire are connected to each other by receiving and engaging the connector at the front end of the lead wire with the inner space of the rear cylindrical body in the body portion, whereby the pin and the wire can be conductive. The pin type initiator mentioned above can make a overall size of the initiator compact and be easily treated by independently attaching the connector and the lead wire for electrifying afterwards. In the pin type initiator mentioned above, by arranging the respective end surfaces of the center pin, the eyelet and the insulating body on the same plane, the initiator assembly which can be easily manufactured and does not increase the cost can be realized. That is, it is possible to provide the electric resistance body (the resistance line in the present specification) converting the electric energy such as the electric signal into a thermal energy between the conductive pin and the conductive component linearly without being bent. That is, the resistance line can be simply and securely connected to the conductive pin and the conductive component.

As the insulating material injection-molded so as to surround a part of the initiator, the plastic material capable of being injection-molded can be used. It is possible to employ an engineering plastic, for example, nylon such as a nylon 6, a nylon 12, a nylon 6–12 and polyester such as a polybutylene terephthalate (PBT), a polyethylene terephthalate (PET). Further, in order to improve a mechanical strength, a glass fiber or the like can be contained in the insulating material.

The other advantages of the present invention can be easily understood from the following description with respect to preferred embodiments shown in the following drawings.

According to the present invention, such an initiator assembly can be realized as that connection to the inflator housing is performed easily, a size of the injection-molded portion (the resin portion) of the plastic material is reduced, and the load of work and the cost at manufacturing is not increased.

In particular, the initiator assembly according to the present invention can easily and securely connect the resistance line to the conductive pin and the conductive component since the respective end surfaces of the center pin, the eyelet and the insulating body are made in the same plane in the pin type initiator.

DESCRIPTION OF REFERENCE NUMERALS

20 Inflator
21 Connector Mounting Means
22 Inflator Housing
23 Connector
24 Inner Tube
25 Lead Wire
28 Initiator Assembly
31 Collar Assembly
32 Initiator
33 Electrical Insulating Body (Glass)
34 Initiator Adapter
36 Resin Portion
40 Metal Collar
42 Projection
46 Metal Eyelet (End Plate)
54 First Conductive Pin (Center Pin)
62 Priming
64 Cover member (Charge Holder)
70 Second Conductive Pin (Grounding pin)

PREFERRED EMBODIMENTS OF THE INVENTION

Figure 1:
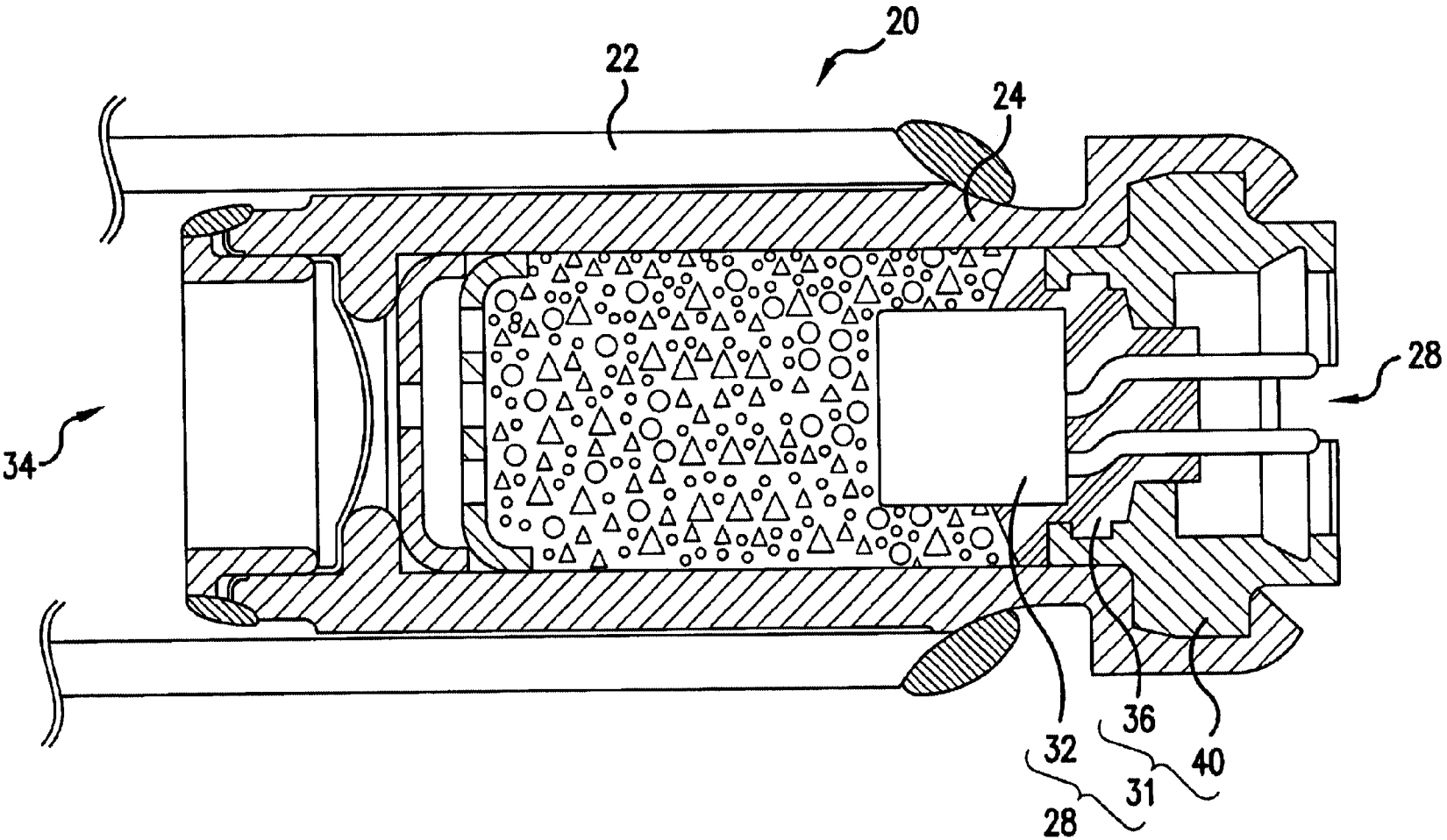
FIG. 1 is a vertical cross sectional schematic view of a main portion showing an inflator in which an initiator assembly of the present invention is used.
Figure 2:
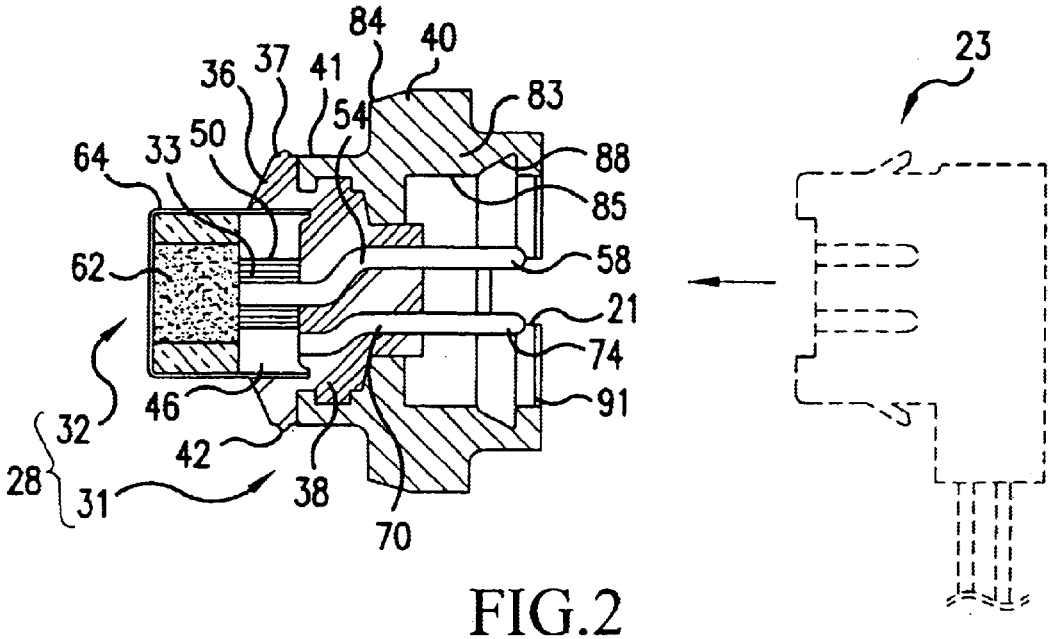
FIG. 2 is a vertical cross sectional schematic view showing one embodiment of the initiator assembly of the present invention.

In FIGS. 1 and 2, there is shown a preferred embodiment of an initiator assembly capable of being used in an inflator for inflating an air bag in a motor vehicle or an inflatable article.

An inflator 20 includes an inflator housing 22 and an initiator adapter 34. An initiator assembly 28 is joined to one end (that is, an inner tube 24) of the initiator adapter 34. The initiator assembly 28 comprises an initiator 32, a metal collar 40 and an insulating material injection-molded between the initiator and the collar. In the following description, for convenience of explanation, a combination between the metal collar 40 and the insulating material to be injection-molded is called as a collar assembly 31.

Accordingly, the initiator assembly 28 comprises the initiator 32 and the collar assembly 31. The collar assembly 31 includes a resin portion 36 (that is, an insulating material) made of a molding plastic material corresponding to an injection-molded insulating material and the metal collar 40, and a conductive pin side of the initiator 32 is surrounded by the resin portion 36. The metal collar 40 is joined to the resin portion 36. In order to integrally join the collar assembly 31 comprising the resin portion 36 and the metal collar 40 to the initiator 32, an injection-molding process is employed. In this case, the plastic material constituting the resin portion is charged between the periphery of a base portion of the initiator 32 and a front end portion of the metal collar 40 in accordance with the injection-molding process. When the plastic material is solidified, the metal collar 40 is fixed on the resin portion 36, and the resin portion 36 is fixed on the initiator 32.

Next, a preferred embodiment of the initiator assembly according to the present invention will be described with reference to FIG. 2 in particular.

The initiator 32 includes a metal eyelet (an end plate) 46, and a hole 50 is formed therein. The upper portion of a first conductive pin (center pin) 54 having a tip 58 is positioned to pass through the hole 50, and the center pin 54 is positioned, insulated against the metal eyelet 46 by a glass 33 corresponding to an electric insulating body. The center pin 54 transmits an igniting signal for igniting a priming 62. A cover member (a charge holder) 64 made of a metal wall surrounds and covers the priming 62, and is welded to the eyelet 46. The initiator 32 further includes a second conductive pin (a grounding pin) 70 having a tip 74. The grounding pin 70 is insulated from the first conductive pin (the center pin) 54. The glass 33 provides an electric insulation between the first and second conductive pins 54 and 70.

Figure 3A:
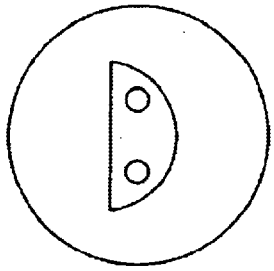
FIGS. 3*a* and 3*b* is a bottom elevational schematic view showing a projection of a D feature type or a T feature type.
Figure 3B:
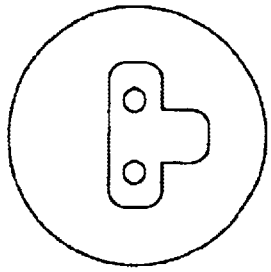

The molding plastic material for forming the resin portion 36 can include various kinds of compositions including a plastic suitable for an electrical insulation and an injection-molding. The resin portion 36 made of the molding plastic material surrounds the metal eyelet 46 of the initiator 32 and two conductive pins 54 and 70, and the metal collar 40 is arranged on the outside thereof. The resin portion 36 made of the molding plastic material is integrally resin-molded, including the metal collar 40. At this time, the respective end surfaces of the center pin 54, the eyelet 46 and the glass 33 holding the center pin 54 in the hole 50 inside the eyelet 46 are placed on the same plane. Further, the end peripheral surface 37 of the resin portion 36 made of the molding plastic material and the end peripheral surface 41 of the metal collar 40 surrounding the resin portion 36 form a continuous circumferential surface frictionally fitted into the inner tube 24 in the initiator adapter shown in FIG. 1, and the projection 42 is formed on the end peripheral surface 37 of the resin portion 36. The projection 42 increases a friction between the inner tube 24 of the inflator and the initiator assembly 28, prevents the initiator assembly 28 from being shaky and rotating, and facilitates a crimping process of the inner tube 24. A base portion 38 of the resin portion 36 in which the conductive pins 54 and 70 go through insulates the metal collar 40 from the conductive pins 54 and 70. Further, a shoulder portion 84 is provided in an end portion of the circumferential surface of the body portion 83 in the metal collar 40 so as to protrude outwardly in the radial direction, and an inner cavity 85 is formed in a rear end side therefrom. A surface of the cavity 85 existing inside the collar is not covered with the molding plastic material and the metal collar is exposed. The tips 58 and 74 of the first and second conductive pins 54 and 70 protrude within the cavity 85, however, the tips 58 and 74 of these pins do not protrude over the cavity 85 of the metal collar 40. This is provided for the reason of preventing the pin from being deformed during an assembling of the initiator. A connector 23 shown by a chain line in the drawing is fitted and connected to the cavity 85. That is, the inner portion of the cavity 85 forms a connecting portion to which the connector is fitted and inserted. A recessed notch 88 is provided inside an end portion of the connector connecting cavity 85 of the metal collar 40 in the circumferential direction, thereby forming a dislocation-preventing means of the fitted connector. Further, a D feature type or a T feature type projection shown in FIGS. 3*a* and 3*b* is provided on the inner bottom surface of the cavity to which the tips 58 and 74 of the first and second pins protrude. More particularly, the D-letter shaped or the T-letter shaped projection (or recess) is formed in the insulating material (the forming resin) exposing to the bottom surface in the connector connecting space. This serves to coincide the pins 54 and 70 of the initiator with positive (+) and negative (−) poles of the connector. Further, a mounting means 21 of a connector with a lead wire is provided on a connector receiving end surface 91 of the metal collar 40, thereby performing a particular orientation of the lead wire with respect to the inflator.

Figure 4:
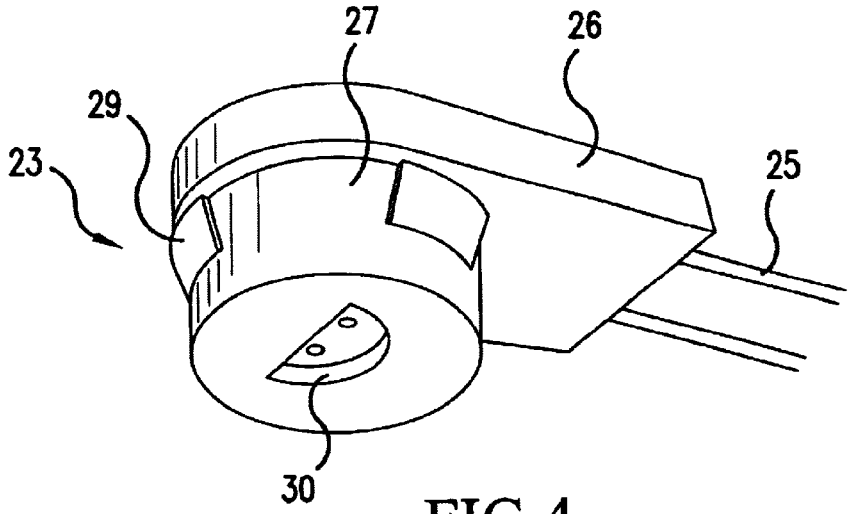
FIG. 4 is a perspective view showing a connector.

FIG. 4 shows the connector 23 fitted to the cavity 85 inside the metal collar 40. As is apparent from FIG. 4, the connector 23 comprises a flat base portion 26 connected to the tip end of the lead wire 25 and a substantially cylindrical connecting portion 27 perpendicular to the base portion, and a lateral shape thereof is formed in a substantially L-letter shape. A convex portion 29 having a shape capable of being fitted into the recessed notch 88 provided inside the end portion of the connector connecting cavity 85 is provided in the connecting portion 27, and the convex portion 29 is securely fitted into the recessed notch 88 by fitting the connecting portion 27 of the connector to the connector connecting cavity 85 of the metal collar 40, whereby the initiator 32 (that is, the initiator assembly 28) and the connector 23 are securely connected. Further, the recess portion 30 corresponding to the D feature type or the T feature type provided on the bottom surface of the cavity 85 inside the collar is formed on the end surface of the connecting portion 27, and both of the elements are formed so as to be complementarily fitted. In the case that a D-letter shaped or a T-letter shaped recess is formed on the bottom surface of the cavity 85, the recess portion 30 formed on the end surface of the connecting portion 27 may be formed as a convex portion so as to complementarily fit thereto. In the drawing, the recess portion 30 formed on the end surface of the connecting portion 27 is formed as the D feature type. Both of the elements are fitted to each other, whereby the pins 54 and 70 of the initiator coincide with the positive (+) and negative (−) poles of the connector, and further it is possible to keep a drawing direction of the lead wire 25 extending from the connector 23 constant.

Figure 5:
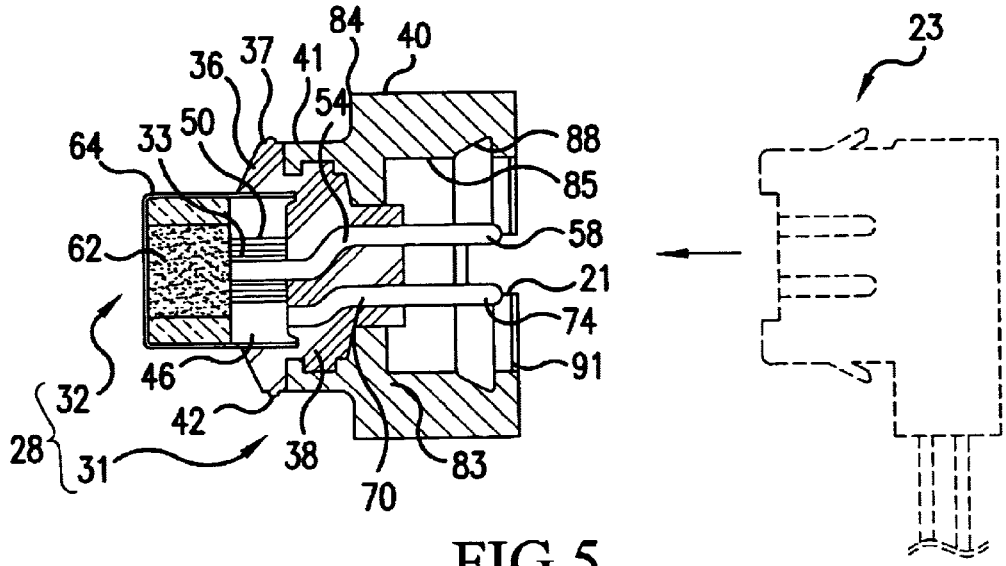
FIG. 5 is a vertical cross sectional schematic view showing another embodiment of the initiator assembly of the present invention.

In the initiator assembly 28 structured in the above manner, when the igniting signal is transmitted to the center pin 54 and the grounding pin 70, the priming 62 is ignited so as to break the cover member 64 made of the metal wall. In order that the cover member 64 made of metal can be easily and securely broken at that time, it is preferable that a notch is provided in a circular end portion of the cover member 64. Further, with respect to the initiator assembly shown in FIG. 2, an initiator assembly in accordance with an aspect shown in FIG. 5 can be employed. The initiator assembly shown in this drawing is particularly structured such that the outer peripheral surface in a rear end side from the outer peripheral surface fitted into the inner tube of the inflator, that is, the outer peripheral surface from the shoulder portion 84 to the connector receiving end surface 91, in the metal collar portion 40 is formed to be flat. Further, the projection 42 formed on the end peripheral surface 37 of the resin portion 36 is optionally formed larger, in a view of disposing condition in the gas generator. In FIG. 5, the reference numerals are attached to the same structures as those in FIG. 2, and a description thereof will be omitted.

In this case, in the initiator assembly shown in FIGS. 2 and 5, the projection 42 is formed so as to protrude in a hemispherical shape or a conical shape, however, is not limited to this. That is, the projection 42 can be employed as far as having a function capable of being fitted to the inner tube of the inflator, and may be formed in the other shapes, for example, a belt-like shape formed along the peripheral direction of the end peripheral surface 37 in the resin portion, or the like, that is, in various shapes and structures. In other words, the projection 42 can be formed so as to be in contact with the inner surface of the inner tube in the inflator at a point or/and on a surface, and the contact between both members may be realized in a dispersed, a discontinuous way or a continuous way along the peripheral direction of the end peripheral surface 37 in the resin portion. Further, in the case of forming the projection 42 in a dispersed way or a discontinuous way, the projection 42 can be arranged in a staggering way in addition to being arranged in line along the peripheral direction of the end peripheral surface 37 of the resin portion.

Figure 6:
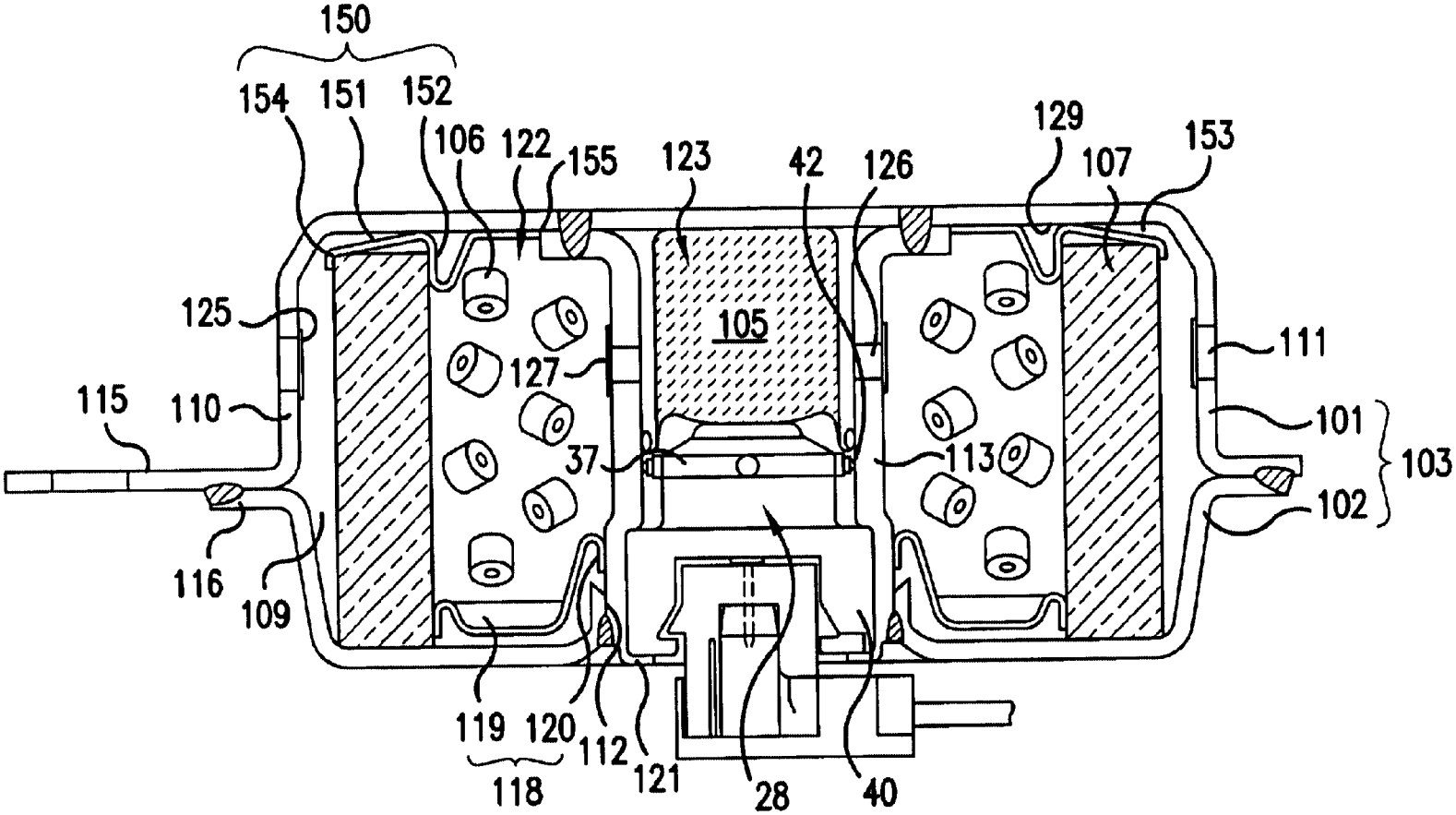
FIG. 6 is a vertical cross sectional schematic view showing another gas generator using the initiator assembly of the present invention.

Further, the initiator assembly mentioned above can be used in a gas generator for an air bag, for example, as shown in FIG. 6. FIG. 6 is a cross sectional schematic view showing a gas generator for an air bag, which comprises the initiator assembly 28 formed in the same manner as that mentioned above.

In the gas generator shown in this drawing, an inner cylindrical member (that is, an inner tube) 113 is disposed in a housing 103 comprising a diffuser shell 101 and a closure shell 102 to define an igniting means accommodating chamber 123 inside the inner cylindrical member and a gas generating agent combustion chamber 122 outside the inner cylindrical member. In the igniting means accommodating chamber 123, the initiator assembly 28 shown in FIG. 5 and a transfer charge 105 to be ignited and burnt upon activation of the initiator assembly 28 are stored as an ignition means to be activated upon the impact for igniting and burning the gas generating agent 106. Further, in the combustion chamber 122, a gas generating agent 106 to be ignited and burnt by the igniting means to generate a working gas and a substantially disc-shaped under plate 118 for supporting the gas generating agent 106 and restricting a movement thereof are arranged. A plurality of gas discharge ports 111 are arranged in a peripheral wall portion 110 of the diffuser shell 101 at equal intervals in the circumferential direction, and the gas discharge port 111 is closed by a seal tap 125. In the closure shell 102, the inner cylindrical member 113 is arranged, being fitted to a center hole 112 thereof. The diffuser shell 101 and the closure shell 102 form a housing 103 by overlapping respective flange portions 115 and 116 in the vicinity of the center in the axial direction of the housing 103 and joining both shells with a laser welding.

In FIG. 6, the initiator assembly 28 particularly described in FIG. 5 is fitted into the inner cylindrical member 113 arranged in the center of the housing 103, and a rear end of the metal collar 40 in the initiator assembly 28 is supported and fixed by crimping an end portion 121 of the inner cylindrical member 113. The projection 42 is formed on a front end circumferential surface 37 of the resin portion (that is, the resin portion 36 in FIG. 5) in the initiator assembly 28. The projection 42 increases a friction between the inner cylindrical member 113 and the initiator assembly 28 and prevents the initiator assembly 28 from being shaky and rotating, thereby facilitating a crimping process of the end portion of the inner cylindrical member 113.

Further, a coolant 107 (coolant/filter means) is disposed in the housing 103 to purify and cool the gas generated due to ignition and combustion of the gas generating agent 106. The coolant 107 is arranged to surround the gas generating agent 106, thereby defining an annular chamber, in other words, a combustion chamber 122 of the gas generating agent 106 in the periphery of the inner cylindrical member 113. The coolant 107 can be formed by laminating a plain-stitched wire mesh made of stainless steel and compressing in the radial direction and the axial direction. As the coolant 107, a coolant which is elasticated easily in the axial direction thereof may be employed. Particularly, the coolant 107 shown in FIG. 6 is made shorter in the axial direction at a degree of a coolant means supporting member 150 arranged on the end surface in the diffuser shell 101 side. A gap 109 is formed between the outer circumferential wall of the housing 103 and the coolant 107, and the gap 109 functions as a gas-flow path.

The coolant means supporting member 150 comprising an annular portion 151, a wall portion 152 and a bent portion 154 is arranged between an axial end portion of the coolant 107 and an upper inner surface 129 of the diffuser shell 101. The coolant means supporting member 150 forms a space portion 153 for insulating heat between the coolant 107 and the diffuser shell 101, and can hold the coolant 107 between the upper and lower end surfaces of the housing 103 due to an elasticity thereof. Further, the wall portion 152 and the bent portion 154 thereof prevent the working gas generated due to the combustion of the gas generating agent 106 from passing through the end surface of the coolant 107. Further, since the wall portion 152 is formed so as to be bent in a substantially "U-letter" shape, it is possible to prevent the gas generating agent 106 stored in the combustion chamber 122 from entering into the end surface of the coolant 107 at a time of assembling the gas generator. This coolant means supporting member 150 is positioned by a central opening 155 formed in the center of the annular portion 151 and arranged in the housing 103.

In the inner periphery of the coolant 107, it is possible to arrange a substantially porous cylindrical perforated basket (not shown) which protects the coolant 107 from a flame generated due to the combustion of the gas generating agent 106 and prevents the gas generating agent 106 and the coolant 107 from being in direct contact with each other.

In the above housing 103, a substantially disc-shaped under plate 118 is disposed in a combustion chamber 122 of the gas generating agent defined outside the inner cylindrical member 113. The under plate 118 has a circular portion 119 contacting the gas generating agent 106 and a central hole 120 into which the outer circumferential wall of the inner cylindrical member 113 is fitted and inserted, supports the gas generating agent 106 with the circular portion 119 to block a movement of the gas generating agent 106, and prevents the gas generating agent 106 from being crushed so as not to change a surface area thereof. Further, a circumferential wall of the inner cylindrical member 113 has a plurality of flame-transferring ports 126 arranged at equal intervals, and the flame-transferring ports 126 are closed by a seal tape 127.

In the gas generator shown in this drawing, the transfer charge 105 is ignited and burnt by the initiator assembly 28 activated upon the impact, and the flame thereof breaks the seal tape 127 closing the flame-transferring hole 126 in the inner cylindrical member 113 and flows into the combustion chamber 122. The gas generating agent 106 inside the combustion chamber 122 is ignited and burnt by the flame of the transfer charge 105 to generate the working gas. The working gas is purified and cooled during passing through the coolant 107, passes through the gap 109, breaks the seal tape 125 closing the gas discharge port 111, and is discharged from the gas discharge port 111.

In this case, the initiator assembly according to the present invention can be also employed in a so-called hybrid type gas generator for an air bag using a pressurized gas.

Figure 7:
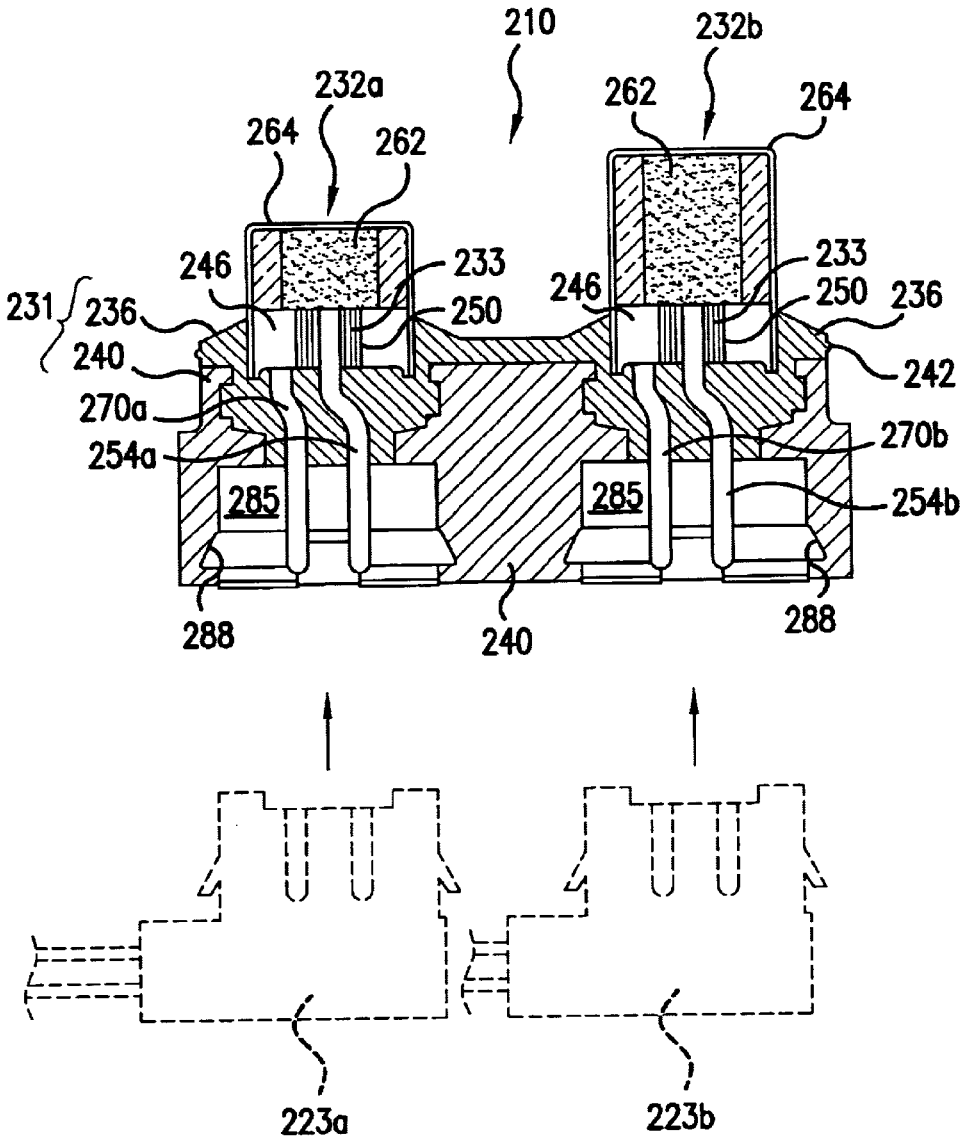
FIG. 7 is a vertical cross sectional schematic view showing the other embodiment of the initiator assembly of the present invention.

Further, in the present invention, an initiator assembly 210 can comprise a first igniter 232*a*, a second igniter 232*b* and a collar assembly 231, as shown in FIG. 7.

The collar assembly 231 includes a resin portion 236 made of a molding plastic material corresponding to an injection-molded insulating material and a metal collar 240, and the first igniter (that is, a first initiator) 232*a* and the second igniter (that is, a second initiator) 232*b* are surrounded by the resin portion 236 at the base portions.

The metal collar 240 is joined to the resin portion 236. In order to integrally join the collar assembly 231 comprising the resin portion 236 and the metal collar 240 to the first igniter 232*a* and the second igniter 232*b*, an injection-molding method is employed. In this case, a liquid or fluidized molding plastic material constituting the resin portion 236 is charged around the base portions of the first igniter 232*a* and the second igniter 232*b* and the front end portion of the metal collar 240. When the plastic material is solidified, the metal collar 240 is fixed on the resin portion 236, and the resin portion 236 is fixed on the first igniter 232*a* and the second igniter 232*b*.

The first igniter 232*a* and the second igniter 232*b* include a metal eyelet (an end plate) 246, and a hole 250 is formed therein. The first igniter 232*a* has a center pin 254*a* and a grounding pin 270*a*, and the second igniter 232*b* has a center pin 254*b* and a grounding pin 270*b*.

The upper portions of the center pins 254*a* and 254*b* go through the holes 250, and the center pins 254*a* and 254*b* are positioned, insulated against the metal eyelet 246 by a glass 233 corresponding to an electric insulating body.

The respective center pins 254*a* and 254*b* receives and transmits the igniting signal for igniting a priming 262. A cover member 264 made of a metal material surrounds and covers the priming 262 and is welded to the eyelet 246. The cover member 264 is preferably provided with a notch in a circular end portion so as to be easily and unfailingly broken. Such a notch can be formed radially as a groove of about 0.10 to 0.25 mm in the case of making the cover member 264 of a stainless steel (SUS305).

The grounding pins 270*a* and 270*b* are insulated from the center pins 254*a* and 254*b* by the glass 233.

The resin portion 236 made of the molding plastic material surrounds the metal eyelets 246 of the first igniter 232*a* and the second igniter 232*b*, the respective center pins 254*a* and 254*b* and the grounding pins 270*a* and 270*b*, and the metal collar 240 is mounted outside thereof.

The resin portion 236 is integrally resin-molded, including the metal collar 240. At this time, the respective end surfaces of the center pins 254*a* and 254*b*, the eyelets 246 and the glasses 233 holding the center pins 254*a* and 254*b* in the holes 250 of the eyelets can be placed on the same plane.

Further, a front end peripheral surface of the resin portion 236 and a front end peripheral surface of the metal collar 240 surrounding the resin portion 236 form a circumferential surface to be frictionally fitted into the inner cylindrical member (reference numeral 304 in FIG. 8), and a projection 242 is formed on a front end peripheral surface of the resin portion 236. This projection 242 increases a friction between the inner cylindrical member 304 and the initiator assembly 210, prevents the initiator assembly 210 from being shaky and rotating and facilitates a crimping process of the inner cylindrical member 304.

The base portions of the resin portion 236 through which the center pins 254*a* and 254*b* and the grounding pins 270*a* and 270*b* pass insulates the metal collar 240 from the center pins 254*a* and 254*b* and the grounding pins 270*a* and 270*b*. The metal collar 240 has a cavity 285 inside, a surface of the cavity 285 is not covered with the plastic material and the metal collar is exposed.

Rear end portions of the center pins 254*a* and 254*b* and the grounding pins 270*a* and 270*b* protrude inside the cavity 285, however, the rear end portions are not exposed out of the cavity 285 of the metal collar 240. This is because the pin can be prevented from being deformed during assembling the initiator. The connectors 223*a* and 223*b* shown by a chain line in the drawing are fitted and connected to the cavity 285. That is, the inside of the cavity 285 serves as a connecting portion to which the connector is fitted. A recessed notch 288 is provided inside the end portion of the connector connecting cavity 285 of the metal collar 240 in the peripheral direction, thereby forming dislocation-preventing means of the fitted connector.

When the center pin 254*a* of the first igniter 232*a* in the initiator assembly 210 is electrified, an electric current flows through the grounding pin 270*a* via a conductive wire, and the priming 262 is ignited and burnt during the process. Further, similarly, when the center pin 254*b* of the second igniter 232*b* is electrified, an electric current flows through the grounding pin 270*b* via a conductive wire, and the priming 262 is ignited and burnt during the process.

The initiator assembly 210 mentioned above can be combined with a transfer charge 316 which is suitably charged in an aluminum cup, or the like so as to form an igniting means. Further, the igniting means can be mounted to the gas generator for the air bag, for example, as shown in FIG. 8, by fitting the initiator assembly 210 into the inner cylindrical member 304 (into a space formed by the inner cylindrical member 304 and a partition wall 307) and crimping a lower end portion 304*a* of the inner cylindrical member 304.

Figure 8:
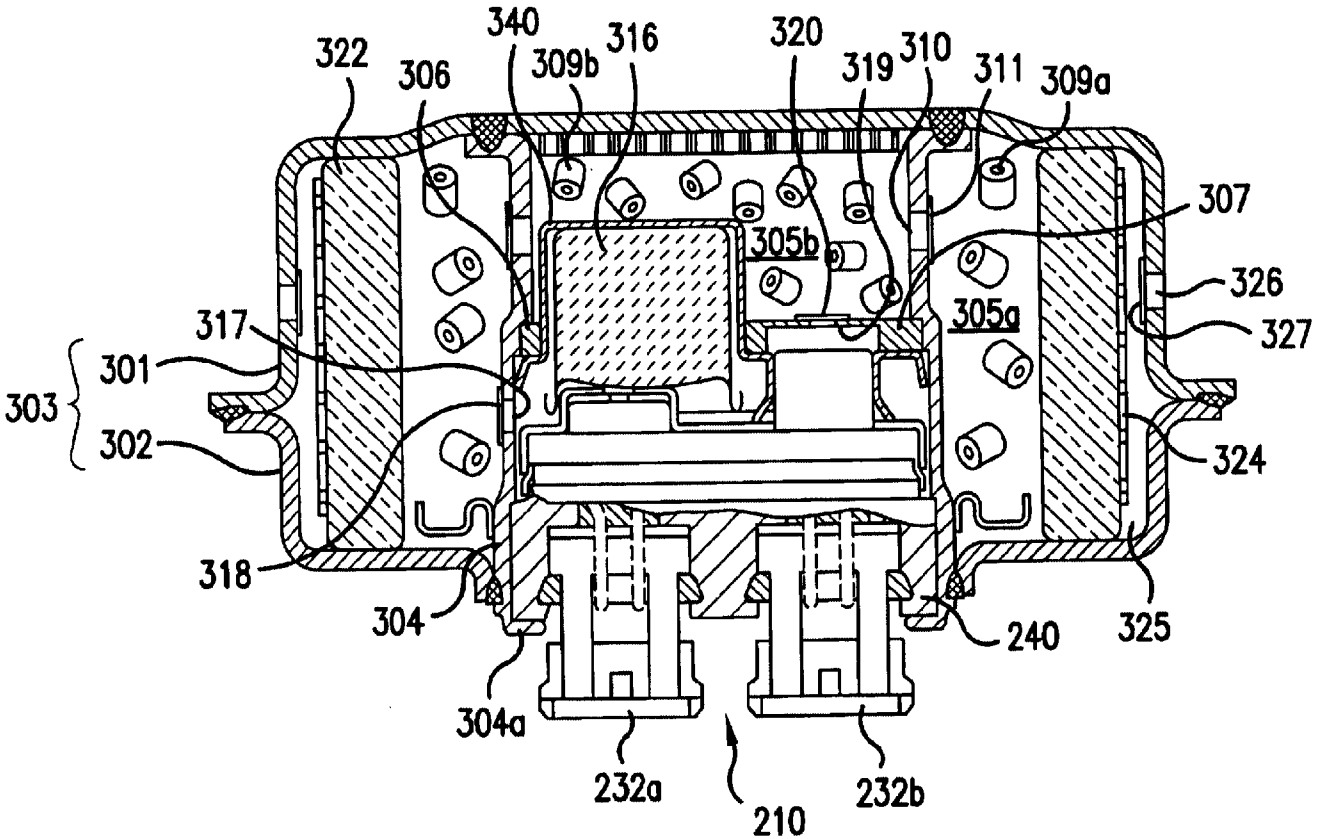
FIG. 8 is a vertical cross sectional schematic view showing the other gas generator using the initiator assembly of the present invention.

FIG. 8 is a vertical cross sectional view of a gas generator for an air bag according to another embodiment using an initiator assembly shown in FIG. 7.

In the gas generator shown in this drawing, a substantially cylindrical inner cylindrical member 304 is arranged in a housing 303 formed by joining a diffuser shell 301 having a gas discharge port 326 to a closure shell 302 forming an inner accommodating space together with the diffuser shell 301, thereby defining a first combustion chamber 305*a* on the outside thereof.

A stepped notch portion 306 is provided inside the inner cylindrical member 304, a substantially disk-shaped partition wall 307 is arranged in the stepped notch portion 306, the partition wall 307 further defines two chambers in the inner cylindrical member 304, a second combustion chamber 305*b* is formed in the diffuser shell side (in the upper space side) and the igniting means is stored in a space sectioned in the closure shell side (in the lower space side).

Gas generating agents 309*a* and 309*b* to be burnt by an actuated igniting means and generate a combustion gas are accommodated in the first and second combustion chambers 305*a* and 305*b*.

The igniting means is provided with the first igniter 232*a* and the second igniter 232*b*, and the first igniter 232*a* and the second igniter 232*b* are to be activated by the activating signal outputted when the sensor detects the impact, and are provided to expose a head portion thereof in parallel to each other in the initiator collar 240 functioning as a holding member.

The first and second igniter 232*a* and 232*b* respectively include two conductive pins (for example, the grounding pin and the center pin), and are connected at a portion contacting with the priming by a conductive wire. Each of the igniters is described in detail on the basis of FIG. 7, therefore, the description thereof will be omitted.

The transfer charge 316 stored in an aluminum cup is arranged above the first igniter 232*a*, and the transfer charge 316 is separated from the second combustion chamber 305*b* by a substantially cylindrical partition member 340 and a partition wall 307 shown in the drawing. A flame-transferring port 317 is provided in the inner cylindrical member 304, and the flame-transferring port 317 is closed by a seal tape 318.

A through hole 310 is provided in the inner cylindrical member 304 defining the first combustion chamber 305*a* and the second combustion chamber 305*b*, and the through hole 310 is closed by a seal tape 311. In this case, since the seal tape 311 is broken when the gas generating agent is burnt, both of the combustion chambers can communicate with each other through the through hole 310. The through hole 310 has a larger opening area than that of the gas discharge port 326, but does not have a function of controlling an internal pressure inside the second combustion chamber 305*b*.

A common coolant/filter 322 for purifying and cooling the combustion gas generated due to the combustion of the first and second gas generating agents 309*a* and 309*b* is provided in the housing 303. It is possible to cover an inner peripheral surface of the coolant/filter 322 in the diffuser shell 301 side with an annular short-pass preventing member (not shown).

An outer layer 324 for suppressing expansion of the filter 322 caused when the combustion gas passes through or the like is provided outside the coolant/filter 322. The outer layer 324 can be formed, for example, by using a laminated wire mesh body.

A gap 325 is formed outside the outer layer 324 so that the combustion gas can pass through the entire surface of the filter 322. The gas discharge port 326 formed in the diffuser shell is closed by a seal tape 327 so as to block the entering of the external air.

When the transfer charge 116 is ignited and burnt by activation of the first igniter 232*a*, the seal tape 318 is broken due to a high-temperature gas generated by the combustion thereof, the high-temperature gas flows into the first combustion chamber 305*a* from the flame-transferring port 317 to ignite and burn the first gas generating agent 309*a*, thereby generating the gas. The gas passes through the common coolant/filter 322 and is discharged from the gas discharge port 326. In the meantime, when the second igniter is activated, the flame breaks the seal tape 320 closing the second flame-transferring port 319 formed on the partition wall 307, and is injected into the second combustion chamber 305*b* through the second flame-transferring port 319 to ignite and burn the second gas generating agent 309*b* and generate a gas. The gas generated in the second combustion chamber 305*b* breaks the seal tape 311 closing the through hole 310 of the inner cylindrical member 304, is ejected out into the first combustion chamber through the through hole 310, passes therethrough, further passes through the coolant/filter 322, and is discharged from the gas discharge port 326.

What is claimed is:

1. An initiator assembly including a priming for being used in an air bag inflator, comprising:

an initiator used for igniting the priming and having at least one conductive pin;

a metal collar for fixing the initiator assembly on the air bag inflator, said metal collar and said initiator being integrally formed by an insulating material injection-molded therebetween, said metal collar including a circumferential wall portion extending in an axial direction thereof and the insulating material including a projection formed on an outer peripheral surface thereof such that an outer end of the projection is projected from a surface defined by an outer surface of the circumferential wall portion, wherein the outer peripheral surface of the insulating material and the outer surface of the circumferential wall portion are exposed in juxtaposed relation to each other and have substantially the same diameter, and wherein the insulating material is a resin made of a plastic material that surrounds a metal eyelet of the initiator.

2. The initiator assembly according to claim 1, wherein the metal collar includes a rear half portion having a cavity in an interior thereof and engaging the air bag inflator with an end portion, an inner peripheral surface of the cavity in the rear half portion is not covered with the insulating material and is exposed.

3. The initiator assembly according to claim 2, wherein a recessed notch is provided to prevent dislocation of a connector on the inner peripheral surface of the cavity.

4. The initiator assembly according to claim 1, wherein the insulating material fits into an inner tube of the air bag inflator when the initiator assembly is provided within the air bag inflator.

5. An initiator assembly including a priming for being used in an air bag inflator, comprising:

an initiator for igniting the priming and having at least one conductive pin;

a metal collar for fixing the initiator assembly on the air bag inflator, said metal collar and said initiator being integrally formed by an insulating material injection-molded therebetween, said metal collar including a circumferential wall portion extending in an axial direction thereof and the insulating material including a projection formed on an outer peripheral surface thereof such that an outer end of the projection is projected from a surface defined by the outer surface of the circumferential wall portion, wherein the outer peripheral surface of the insulating material and the outer surface of the circumferential wall portion are exposed in juxtaposed relation to each other and have substantially the same diameter, and wherein the projection increases a friction between an inner tube of the air bag inflator and the initiator assembly when the initiator assembly is provided within the tube.

6. The initiator assembly according to claim 5, wherein the metal collar includes a rear half portion having a cavity in an interior thereof and engaging the air bag inflator with an end portion, an inner peripheral surface of the cavity in the rear half portion is not covered with the insulating material and is exposed.

7. The initiator assembly according to claim 6, wherein a recessed notch is provided to prevent dislocation of a connector on the inner peripheral surface of the cavity.

8. The initiator assembly according to claims 1 or 5, wherein the metal collar includes a rear half portion having a cavity in an interior thereof and engaging the air bag inflator with an end portion, a tip of the conductive pin going through the insulating material extends into the cavity, and an inner portion of the cavity forms a connecting portion to which a connector is fitted.

9. The initiator assembly according to claims 1 or 5, wherein the metal collar includes a rear half portion having a cavity in an interior thereof and engaging the air bag inflator with an end portion, and a front end of a tip of the conductive pin extending into the cavity does not protrude out of an outer end surface of the cavity.

10. An initiator assembly including a priming for being used in an air bag inflator, comprising:

an initiator for igniting the priming and having at least one conductive pin;

a metal collar for holding the initiator assembly with respect to the air bag inflator, said metal collar and said initiator being integrally formed by an insulating material injection-molded therebetween, said metal collar including a circumferential wall portion extending in an axial direction thereof and the insulating material including a projection formed on an outer peripheral surface thereof such that an outer end of the projection is projected from a surface defined by the outer surface of the circumferential wall portion, wherein the outer peripheral surface of the insulating material and the outer surface of the circumferential wall portion are exposed in juxtaposed relation to each other and have substantially the same diameter, and wherein the metal collar includes a cavity in a rear half portion thereof, that is not covered with the insulating material and an inner peripheral surface of the cavity is exposed.

11. The initiator assembly according to claim 10, wherein a recessed notch is provided to prevent dislocation of a connector on the inner peripheral surface of the cavity.

12. The initiator assembly according to claim 10, wherein the cavity in the interior of the rear half portion of the metal collar engages the air bag inflator with an end portion, a tip of the conductive pin going through the insulating material extends into the cavity, and an inner portion of the cavity forms a connecting portion to which a connector is fitted.

13. The initiator assembly according to claim 10, wherein the cavity in the interior of the rear half portion of the metal collar engages the air bag inflator with an end portion, and a front end of a tip of the conductive pin extending into the cavity does not protrude out of an outer end surface of the cavity.

14. The initiator assembly according to claims 1, 5 or 10, wherein the insulating material is nylon or polyester.

15. The initiator assembly according to claims 1, 5 or 10, wherein the initiator assembly includes at least two initiators, and the at least two initiators are connected to a single metal collar by the injection-molded insulating material.

16. A gas generator for an air bag comprising, in a housing with a gas discharge port, an ignitor including an initiator, assembly and a gas generator to generate a working gas for inflating the airbag upon actuation of the ignitor, wherein the initiator assembly is the initiator assembly according to claims 1, 4 or 9.

* * * * *